US007494426B2

(12) United States Patent
Nishio et al.

(10) Patent No.: US 7,494,426 B2
(45) Date of Patent: Feb. 24, 2009

(54) GOLF CLUB HEAD

(75) Inventors: Masayoshi Nishio, Kobe (JP); Masaya Tsunoda, Kobe (JP)

(73) Assignee: SRI Sports Ltd., Kobe-shi (JP)

( * ) Notice: Subject to any disclaimer, the term of this patent is extended or adjusted under 35 U.S.C. 154(b) by 396 days.

(21) Appl. No.: 11/282,773

(22) Filed: Nov. 21, 2005

(65) Prior Publication Data

US 2006/0111201 A1 May 25, 2006

(30) Foreign Application Priority Data

Nov. 22, 2004 (JP) ..... 2004-337844

(51) Int. Cl.
*A63B 53/04* (2006.01)

(52) U.S. Cl. ..... 473/350

(58) Field of Classification Search ..... 473/346, 473/350

See application file for complete search history.

(56) References Cited

U.S. PATENT DOCUMENTS 5,464,211 A * 11/1995 Atkins, Sr. ..... 473/377
5,718,641 A * 2/1998 Lin ..... 473/224
6,852,038 B2 * 2/2005 Yabu ..... 473/224
2003/0144079 A1 * 7/2003 Yoneyama ..... 473/346
2004/0132544 A1 * 7/2004 Doi ..... 473/345
2006/0194644 A1 * 8/2006 Nishio ..... 473/329
2007/0225086 A1 * 9/2007 Lin ..... 473/342
2008/0004129 A1 * 1/2008 Lin et al. ..... 473/332
2008/0032817 A1 * 2/2008 Lo ..... 473/342

FOREIGN PATENT DOCUMENTS

GB 2 331 249 A 5/1999
JP 10-258142 A 9/1998
JP 11-216204 A 8/1999
JP 2003-290396 A 10/2003

* cited by examiner

*Primary Examiner*—Raeann Trimiew
(74) *Attorney, Agent, or Firm*—Birch, Stewart, Kolasch & Birch, LLP

(57) ABSTRACT

A face backside of a golf club head is provided with six or more ribs extended from a face center toward face circumferences. Angles θ1 to θ6 between respective pairs of adjoining ones of the ribs are less than 90°. One of the ribs that form the smallest angle between its extension direction and a head vertical direction d1 and that extends from the face center toward a crown-side face circumference constitutes an upward rib, which has a smaller cross-sectional area than any of those of the other ribs.

8 Claims, 10 Drawing Sheets

GOLF CLUB HEAD

BACKGROUND OF THE INVENTION

The present invention relates to a golf club head having a face backside thereof reinforced with ribs.

Recently, the golf club heads are becoming larger in size but smaller in thickness, so that a face portion tends to suffer insufficient strength. A method of affixing the ribs to the face backside has been known as a measure for meeting the purposes of reducing the thickness of the face and increasing the strength thereof.

Japanese Unexamined Patent Publication No. 2003-290396 (Claim 1, Claim 2, FIG. 1, FIG. 2) discloses a golf club head wherein a plurality of ribs are provided as extended vertically, wherein the ribs located closer to a toe-side and a heel-side are accordingly decreased in height and wherein the individual ribs have a constant height distribution with respect to a longitudinal direction thereof or heights progressively increased toward a bottom side (sole side).

In spite of a great rib volume (rib weight), the above prior-art golf club head fails to achieve a sufficient face-strength reinforcing effect (hereinafter, referred to as "face reinforcement effect" or simply as "reinforcement effect"). Since all the ribs are extended in the vertical direction, the face is excessively increased in rigidity particularly at its toe-side and heel-side because of the ribs extended in the vertical direction. As a result, face vibration is excessively limited at impact with a ball.

SUMMARY OF THE INVENTION

It is an object of the invention to provide a golf club head featuring high restitution performance while maintaining the sufficient face reinforcement effect by way of the ribs.

A golf club head according to the invention comprises six or more ribs disposed on a face backside, the ribs being extended from a face center toward face circumferences, wherein an angle θ(°) between extension directions of adjoining ones of the ribs is less than 90°, and wherein one of the ribs that forms the smallest angle between its extension direction and a head vertical direction and that extends from the face center toward a crown-side face circumference constitutes an upward rib, which has a smaller cross-sectional area than any of those of the other ribs.

The ribs are laid from the face center toward the face circumferences, thereby diffusing stress exerted on the face more uniformly without excessively increasing the face rigidity. The reason for providing six or more ribs is because if the number of ribs is less than six, rib-free regions are so large that the face tens to suffer the insufficient strength at the rib-free regions. The angle θ between the extension directions of adjoining ones of the ribs is defined to be less than 90° for the following reason. If there is a region having the angle θ of 90° or more, the region tends to suffer the insufficient strength. Furthermore, the aforementioned upward rib is configured to have a relatively small cross-sectional area, whereby the head may be increased in the restitution performance as maintaining the face reinforcement effect.

The head vertical direction is defined as follows.

In a standard state where the head is placed on the horizontal plane at a predetermined loft angle (real loft angle) and a predetermined lie angle, the head vertical direction is defined as a direction of line of intersection between a reference plane and a face surface, the reference plane being defined to include a perpendicular line drawn from a gravity center of the head to the face surface and meets at right angles with the horizontal plane.

On the other hand, the cross-sectional area of the rib is defined as follows.

Provided that a position A is defined to be spaced away from a longitudinal center position of the rib toward one end thereof by a distance of 40% of the overall length thereof (which means hereinafter the overall longitudinal length of the rib) and that a position B is defined to be spaced away from the longitudinal center position of the rib toward the other end thereof by a distance of 40% of the overall length thereof, the cross-sectional area of the rib is defined as a mean value of the cross-sectional areas as determined at longitudinal positions between the position A and the position B.

The cross-sectional area of the aforesaid upward rib may preferably be 2.0 $mm^2$ or more. If the cross-sectional area is less than 2.0 $mm^2$, the face is prone to fracture because of the insufficient face strength. Therefore, the cross-sectional area of the upward rib may more preferably be 4.0 $mm^2$ or more, even more preferably 4.1 $mm^2$ or more and particularly preferably 4.3 $mm^2$ or more. In addition, the cross-sectional area of the upward rib may preferably be 8.0 $mm^2$ or less. If the cross-sectional area exceeds 8.0 $mm^2$, the face is excessively increased in the rigidity so that the face vibration is excessively reduced and the restitution performance tends to decrease. Therefore, the cross-sectional area of the upward rib may more preferably be 6.0 $mm^2$ or less and particularly preferably 5.8 $mm^2$ or less.

The cross-sectional area of each of the other ribs than the upward rib may preferably be 4.0 $mm^2$ or more. If the cross-sectional area of each of the other ribs is less than 4.0 $mm^2$, the face is prone to fracture because of the insufficient face strength. Therefore, the cross-sectional area of each of the other ribs may more preferably be 5.0 $mm^2$ or more, even more preferably 5.8 $mm^2$ or more and particularly preferably 6.1 $mm^2$ or more.

In addition, the cross-sectional area of each of the other ribs than the upward rib may preferably be 10.0 $mm^2$ or less. If the cross-sectional area of each of the other ribs exceeds 10.0 $mm^2$, the face is excessively increased in the rigidity so that the face vibration is excessively reduced and the restitution performance tends to decrease. Therefore, the cross-sectional area of each of the other ribs may more preferably be 8.0 $mm^2$ or less, even more preferably 7.6 $mm^2$ or less and particularly preferably 7.5 $mm^2$ or less. In a case where two upward ribs are provided, the cross-sectional area of the upward rib is defined as a mean value of the cross-sectional areas of the two ribs.

The aforesaid ribs may preferably have widths of 3 mm to 14 mm and heights of 0.3 mm to 1.5 mm. If the rib width is smaller than 3 mm, the stress tends to concentrate on a rib having a relatively small width so that the rib is prone to fracture at an edge portion thereof. If the rib width is greater than 14 mm, the face is excessively increased in the rigidity and the restitution performance tends to decrease. If the rib height is smaller than 0.3 mm, the face reinforcement effect by way of the ribs is decreased. If the rib height is greater than 1.5 mm, the stress tends to concentrate on the rib.

In the aforementioned golf club head, a face thickness may preferably be 0.5 mm or more and 3.5 mm or less. If the face thickness is less than 0.5 mm, the face tends to be reduced in the face strength. If the face thickness exceeds 3.5 mm, the face is excessively increased in the rigidity so that the restitution performance may be reduced.

In the above golf club head, a roundness of a curvature radius R(mm) may preferably be imparted to an intersection of boundary lines of a respective pair of adjoining ones of the ribs. The value of a ratio (θ/R) between the curvature radius R(mm) and the angle θ(°) between the adjoining ribs may preferably be in the range of 3 to 50. If the value of (θ/R) is less than 3, the curvature radius R is too great relative to the angle θ and hence, the face is excessively increased in a thick area so that the restitution coefficient tends to decrease. On the other hand, if the value of (θ/R) exceeds 50, the curvature radius R is too small relative to the angle θ and hence, the face is decreased in the thick area while the stress tends to concentrate on the intersection of the boundary lines. Hence, the head tends to be reduced in durability.

According to the invention as described above, six or more ribs are provided as extended from the face center toward the face circumferences, and the upward rib is configured to have the smaller cross-sectional area than that of each of the other ribs. Therefore, the head of the invention is adapted to achieve the increased restitution performance as maintaining the face reinforcement effect.

DETAILED DESCRIPTION

Preferred embodiments of the invention will hereinbelow be described with reference to the accompanying drawings.

Figure 4:
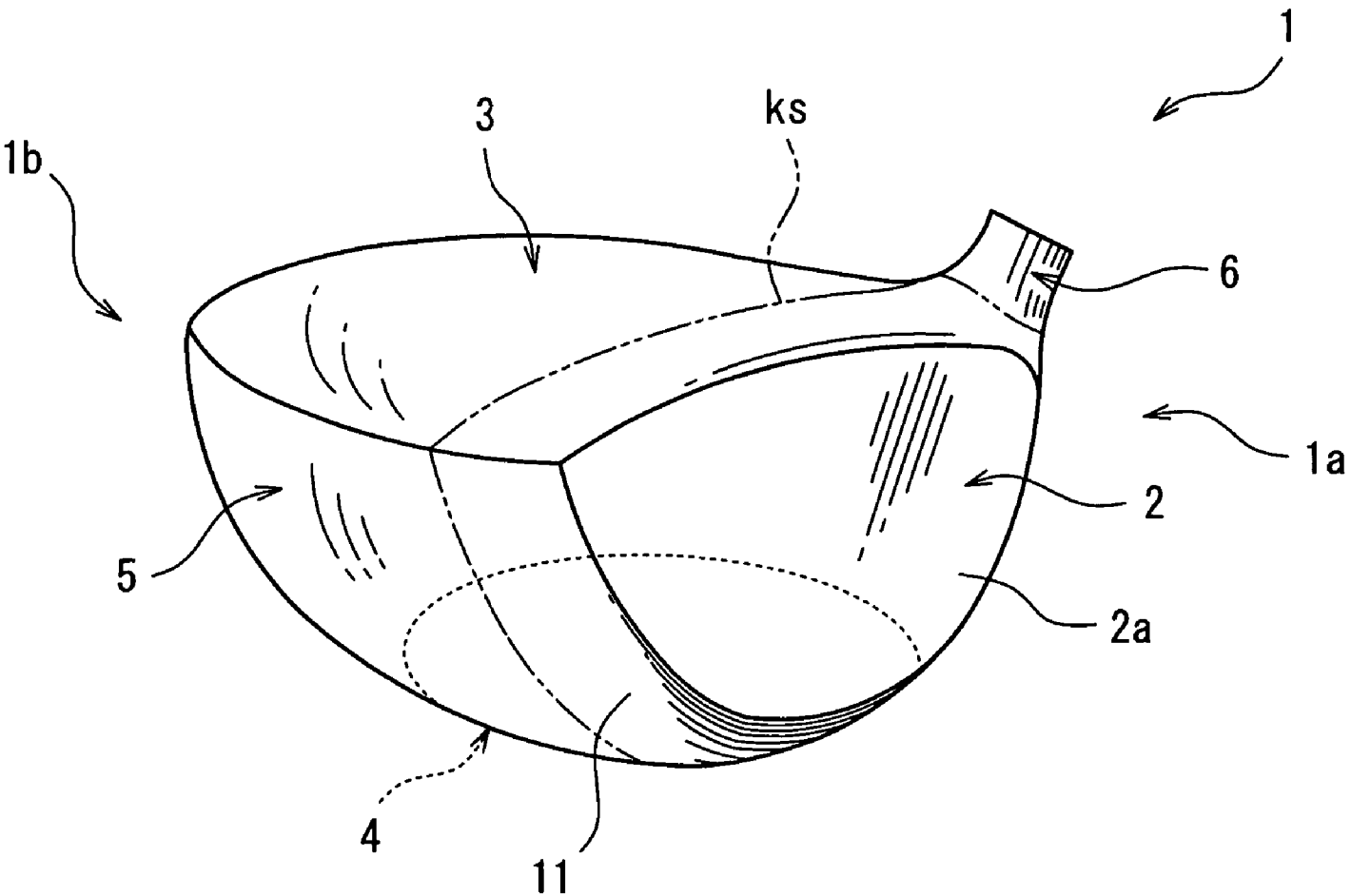
FIG. 4 is a perspective view showing the whole body of the golf club head of FIG. 1.

FIG. 4 is a perspective view showing the whole body of a golf club head (hereinafter, simply referred to as "head") 1 according to a first embodiment of the invention. The head 1 is a golf club head of a so-called wood type and includes: a face portion 2 for striking a ball; a crown portion 3 constituting a top surface of the head 1 as extending from an upper edge of the face portion 2 toward a rear side of the head; a sole portion 4 constituting a bottom surface of the head 1 as extending from a lower edge of the face portion 2 toward the rear side of the head; a side portion 5 constituting a portion except for the face portion 2 as extended between the crown portion 3 and the sole portion 4; and a hosel portion 6 including a shaft hole (not shown) to which a shaft (not shown) is insertedly bonded. The head 1 has a hollow structure, the interior of which is hollowed out.

The head 1 is formed from a metal such as a titanium alloy, having a two-piece structure wherein two members are bonded together. In FIG. 4, a phantom line (chain double-dashed line) indicates a boundary line ks between the two members bonded together. Specifically, the head 1 is formed by bonding together a cup-face 1*a* and a head body 1*b* by welding along the boundary line ks. The cup-face 1*a* is substantially shaped like a cup and includes the overall face portion 2 and a rising portion 11 extending from circumferences of the face portion 2 toward the rear side of the head, thus constituting a front portion of the head 1. The head body 1*b* includes the portions of the head 1 that exclude the cup-face 1*a*, thus constituting a rear portion of the head 1. The rising portion 11 of the cup-face 1*a* defines respective face-side parts of the crown portion 3, the sole portion 4 and the side portion 5. The head body 1*b* defines respective rear-side parts of the crown portion 3, the sole portion 4 and the side portion 5 as well as the hosel portion 6. The whole body of the head 1 is formed from a titanium alloy. The cup-face 1*a* is formed by forging whereas the head body 1*b* is formed by lost wax precision casting.

The invention does not particularly limit the material of the head 1. For example, a variety of metals, fiber-reinforced plastics and the like are usable. Examples of the usable metal include titanium, titanium alloys, stainless steel alloys, aluminum alloys, magnesium alloys and the like. These metal materials may be used alone or in combination of plural types. Examples of a usable titanium alloy include 6Al-4V titanium, 15V-3Cr-3Al-3Sn titanium, 15Mo-5Zr-3Al titanium, 13V-11Cr-3A1 titanium and the like. Beta titanium alloys having high strength, in particular, may favorably be used for forming the face portion 2. Examples of a usable fiber-reinforced plastic include plastics reinforced with carbon fiber. The face portion 2 may use a rolled material or a forged material so as to increase the strength, whereas the other portions may use cast articles having high design freedom. Then, these portions may be unified by welding. This method is preferred from the viewpoint of achieving both the strength and the higher freedom of configuration design. On the other hand, a plastic reinforced with carbon fiber may be used for forming a part or the whole body of the crown portion 3, while the other portions may be formed by forging metals. This method is preferred in terms of ease of setting a low gravity center.

Figure 1:
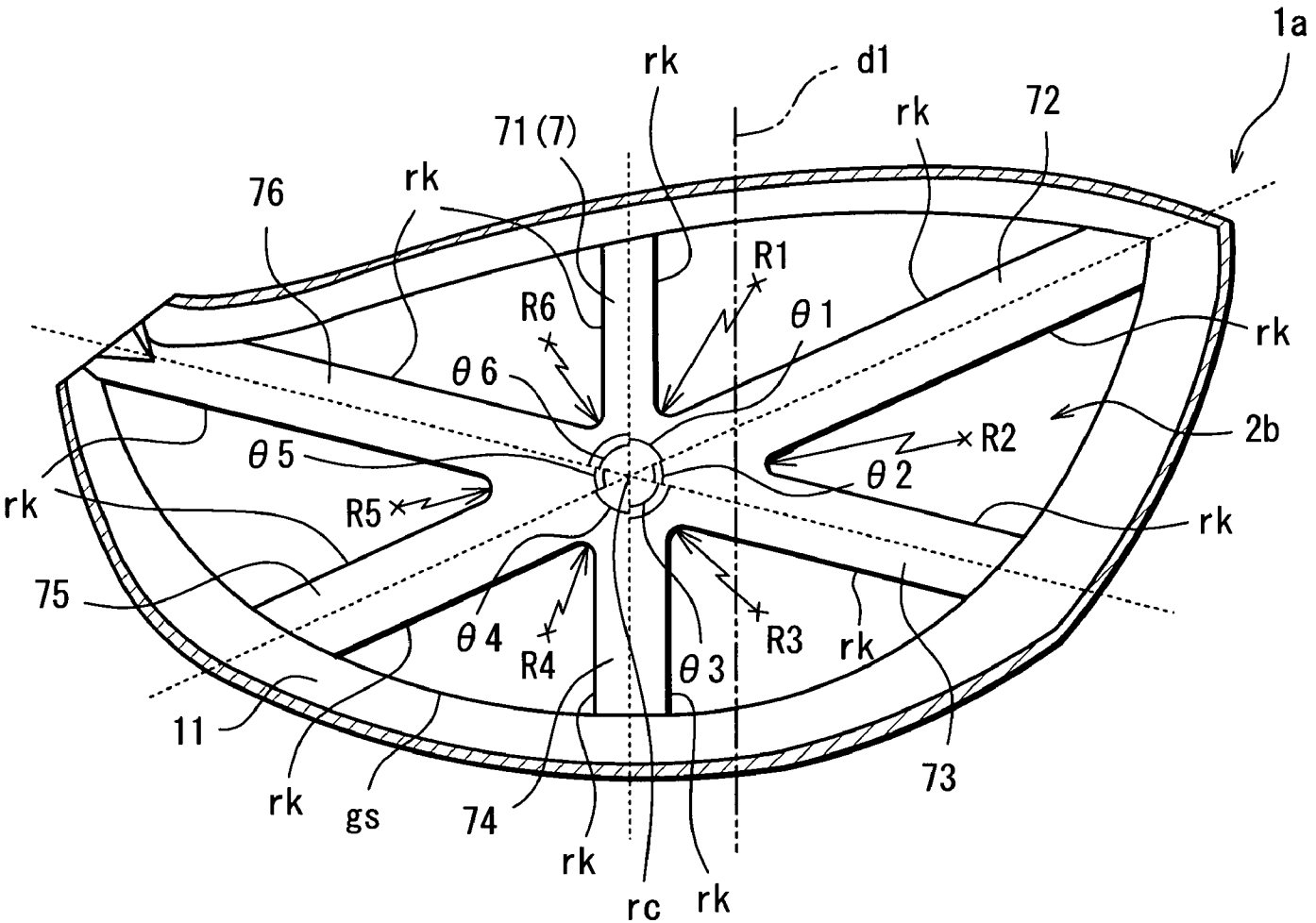
FIG. 1 is a plan view showing a cup-face of a golf club head according to one embodiment (and Examples 1 to 10) of the invention as viewed from place opposite a face backside.

The head 1 has the hollow structure as described above. The face portion 2 includes: a face surface 2*a* defining an outside surface thereof and contacting a ball at impact with the ball; and a face backside 2*b* defining an inside surface of the face surface or the backside of the face surface 2*a*. FIG. 1 is a plan view showing the cup-face 1*a* as viewed from place opposite the face backside 2*b*. A hatched area in FIG. 1 represents an end face of the cup-face 1*a*. The cup-face is welded to the aforementioned head body 1*b* at the end face.

As shown in FIG. 1, disposed on the face backside 2*b* are a total number of six ribs 71 to 76 for reinforcing the face portion 2, the ribs being extended from a face center toward face circumferences. These ribs 71 to 76 have their face-center side ends located substantially at the same position and are radially arranged. Each of the ribs 71 to 76 is extended from the face center to a face outside circumference gs (an outside edge of the face backside 2*b*). In FIG. 1, an area defined between the face outside circumference gs and the end face (hatched area) of the cup-face 1*a* represents (an inner side of) the rising portion 11 of the cup-face 1*a* described above.

In the head 1, an angle between extension directions (represented by broken lines in FIG. 1) of a respective pair of adjoining ones of the ribs is defined to be less than 90°. Specifically, as shown in FIG. 1, an angle θ1 between the extension directions of the adjoining ribs 71 and 72 is less than 90°, whereas an angle θ2 between the extension directions of the adjoining ribs 72 and 73 is also less than 90°. Likewise, respective angles (θ3, θ4, θ5, θ6) between the extension directions of adjoining rib pairs (73 and 74, 74 and 75, 75 and 76, 76 and 71) are all less than 90°.

While boundary lines rk each dividing the rib portion from a non-rib portion are present on widthwise opposite sides of each of the ribs 71 to 76, an intersection of the boundary lines rk of the adjoining ribs is rounded (chamfered) to impart a roundness of a curvature radius R=1 to 15 mm. Specifically, as shown in FIG. 1, a roundness of a curvature radius R1 (=1 to 15 mm) is imparted to an intersection of the boundary line rk of the rib 71 and the boundary line rk of the rib 72. The curved line of the curvature radius R1 is smoothly continuous to both of the boundary lines rk and is protruded toward a center rc of the rib intersection. Likewise, roundnesses of curvature radii R2, R3, R4, R5, R6 (each ranging from 1 to 15 mm) are imparted to the respective intersections of the boundary lines rk of the ribs 71 to 76.

In such a configuration, the head is increased in durability because a thick area of the face is increased by virtue of the roundnesses imparted to the respective intersections of the boundary lines of the adjoining ribs and because stress concentration on the intersections is reduced. The reason for defining the curvature radius R to be 1 mm or more is as follows. If the curvature radius R1 is less than 1 mm, the durability tends to decrease because the effects to increase the thick area and to reduce the stress concentration are reduced. Therefore, the curvature radius R may more preferably be 2 mm or more. The reason for defining the curvature radius R to be 15 mm or less is as follows. If the curvature radius exceeds 15 mm, the thick area of the face is increased so much that the restitution coefficient tends to decrease. Therefore, the curvature radius R may more preferably be 14 mm or less and particularly preferably 12 mm or less.

Figure 10:
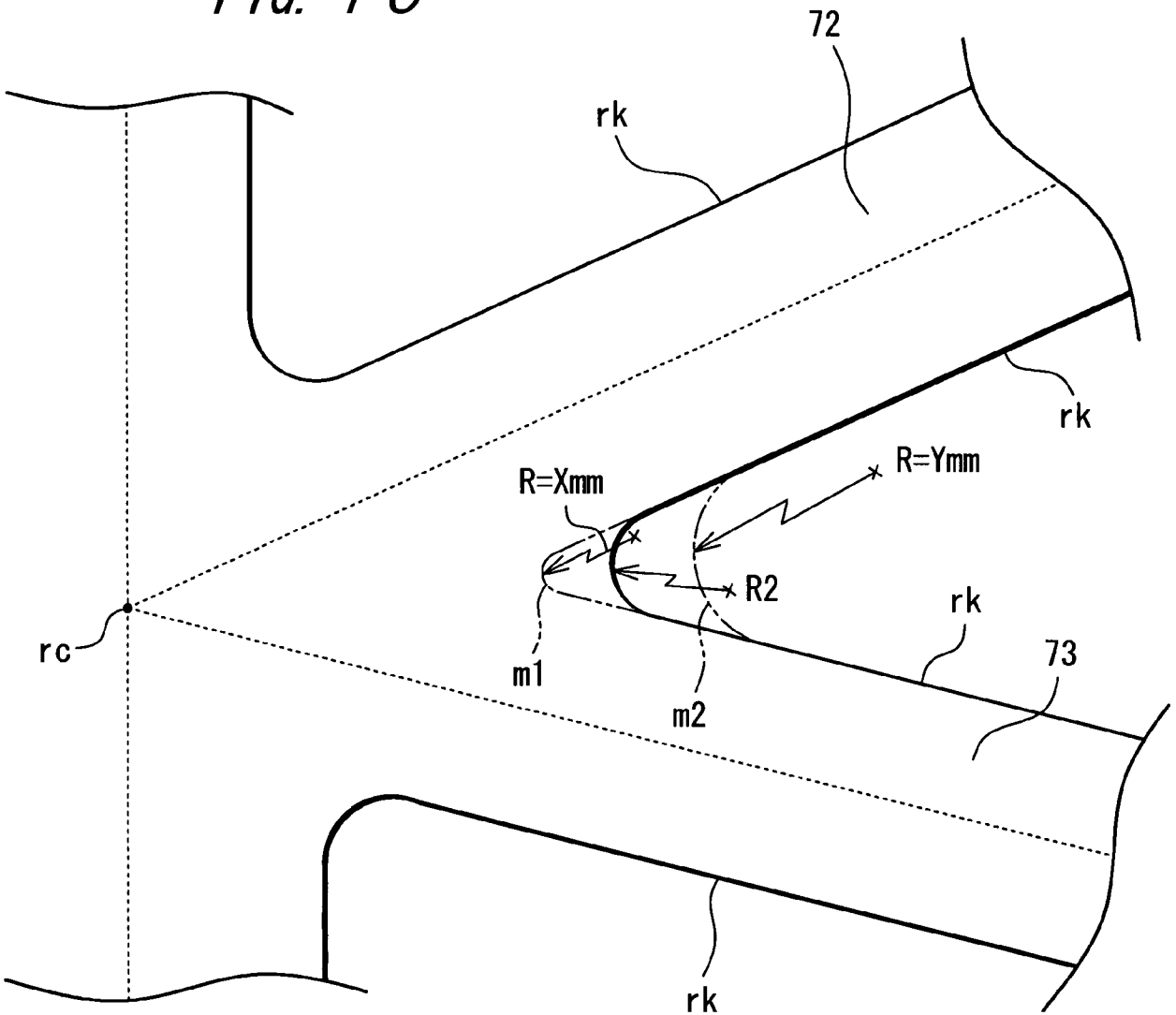
FIG. 10 is an enlarged view showing an intersection of rib boundary lines in FIG. 1.

The meaning of "the roundness of the curvature radius R of Xmm or more" and "the roundness of the curvature radius R of Ymm or less" herein are explained by way of example of the adjoining ribs 72 and 73 according to the embodiment of FIG. 1. FIG. 10 is an enlarged view showing a region near the intersection of the boundary line rk of the rib 72 and the boundary line rk of the rib 73.

"The roundness of a curvature radius R2 of Xmm or more" means that a curved line of the curvature radius R2 is farther away from the center position rc of the rib intersection than a curved line m1 which is smoothly continuous to both of the boundary lines rk of the ribs 72, 73 intersecting each other, which is protruded toward the center position rc of the rib intersection and which has the curvature radius of Xmm.

"The roundness of the curvature radius R2 of Ymm or less" means that the curved line of the curvature radius R2 is closer to the center position rc of the rib intersection than a curved line m2 which is smoothly continuous to both of the boundary lines rk of the ribs 72, 73 intersecting each other, which is protruded toward the center position rc of the rib intersection and which has the curvature radius of Ymm.

The above roundness need not define an arc having a single curvature radius and may also define a combination of arc portions having different curvature radii. In the case of the roundness defining a combination of arc portions having different curvature radii, it is preferred from the viewpoint of durability and restitution that the roundness does not include an arc portion having a curvature radius R of less than 0.5 mm. It is more preferred that the roundness does not include an arc portion having a curvature radius R of less than 1.0 mm. In addition, it is preferred that the roundness does not include an arc portion having a curvature radius R of more than 20 mm. It is more preferred that the roundness does not include an arc portion having a curvature radius R of more than 15 mm. Considering stress diffusion at the intersection of the boundary lines rk, it is most preferred that the above roundness has a single R (single curvature radius).

The value of a ratio (θ/R) between the above curvature radius R(mm) and the angle θ(°) between the ribs is defined to be 3 to 50. Specifically, the value (θ1/R1) of a ratio between the above curvature radius R1 (mm) and the angle θ1(20) is defined to be 3 to 50. Likewise, the respective values of (θ2/R2), (θ3/R3), (θ4/R4), (θ5/R5), (θ6/R6) are also defined to be 3 to 50. The reason for defining the value of (θ/R) to be 3 or more is because if the value of the ratio is less than 3, the curvature radius. R is so great relative to the angle θ that the face is excessively increased in the thick area and hence, the restitution coefficient tends to decrease. Therefore, the value of (θ/R) may more preferably be 6 or more. The reason for defining the value of (θ/R) to be 50 or less is because if the value of the ratio exceeds 50, the curvature radius R is so small relative to the angle θ that the stress tends to concentrate on the intersection of the boundary lines and hence, the durability tends to decrease. Therefore, the value of (θ/R) may more preferably be 22 or less.

It is preferred to define a relationship:

$$R(1) \geqq R2 \geqq \ldots \geqq R(m) \text{ and } R(1) > R(m), \quad \text{(a)}$$

provided that the aforesaid plural angles θ are represented by θ(1), θ(2), . . . , θ(m) in the descending order of the values thereof, and that an inter-rib curvature radius R with respect to the angle θ(1) is represented by R(1), an inter-rib curvature radius R with respect to the angle θ(2) is represented by R(2), . . . , and an inter-rib curvature radius R with respect to the angle θ(m) is represented by R(m). It is more preferred to define a relationship:

$$R(1) > R(2) > \ldots > R(m). \quad \text{(b)}$$

As described above, it is preferred to limit the value of the ratio (θ/R) to the predetermined range. Therefore, the relation between the curvature radius R and the angle θ may be optimized by defining the magnitude relations between the curvature radii R and the angles θ as illustrated by the above expressions (a) and (b).

It is noted that the individual values of the curvature radii in the above expressions (a) and (b) are expressed in millimeters and are rounded off to the whole numbers.

Out of the ribs 71 to 76, an upward rib 7 (equivalent to the rib 71 in this embodiment) has a smaller cross-sectional area than that of each of the other ribs 72 to 76. The upward rib forms the smallest angle between its extension direction and a head vertical direction d1 (indicated by the chain double-dashed line in FIG. 1) and extends from the face center toward a crown-side circumference of the face.

Figure 7:
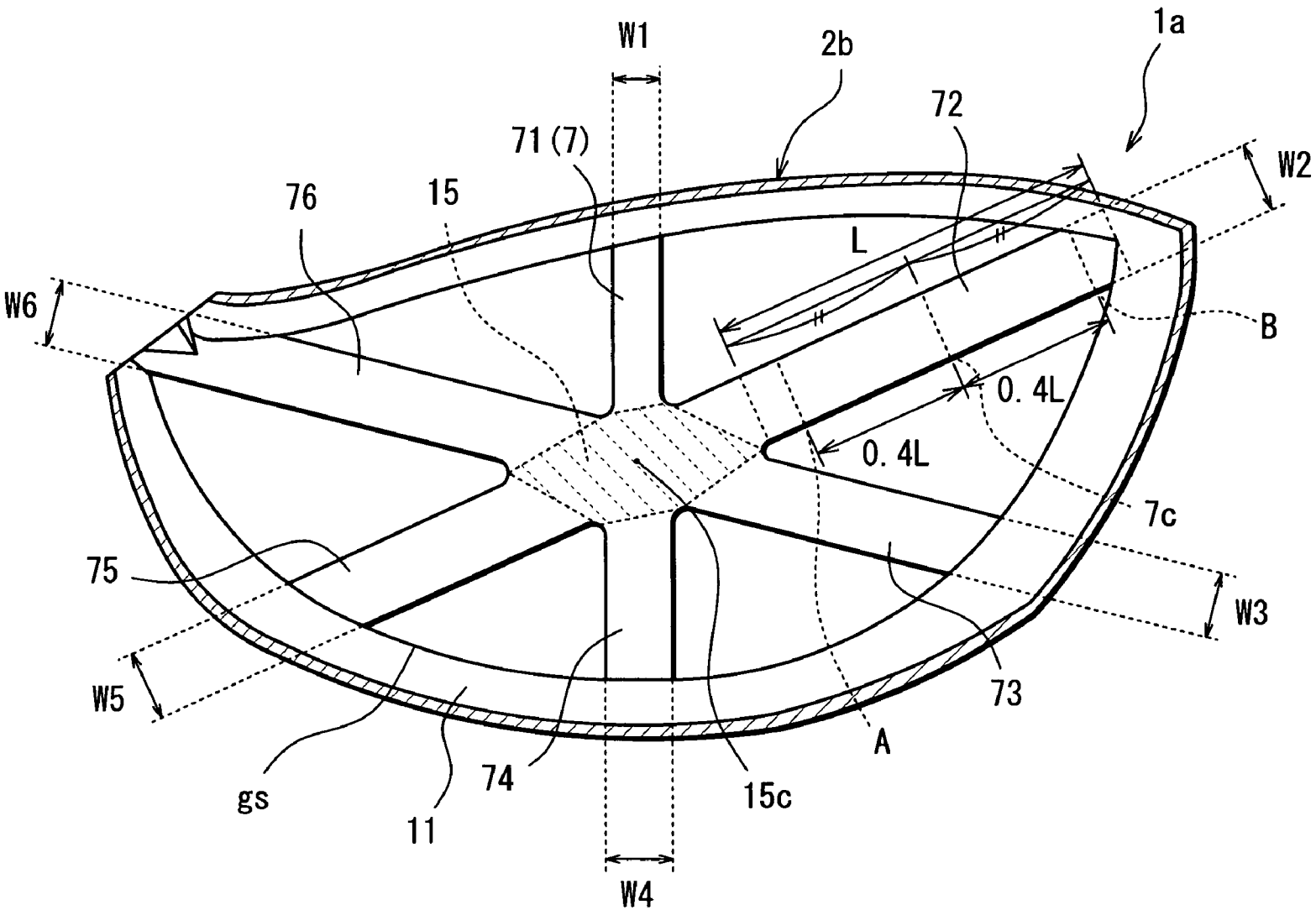
FIG. 7 is a plan view showing, similarly to FIG. 1, the cup-face of the golf club head according to one embodiment (and Examples 1 to 10) of the invention as viewed from place opposite the face backside.

While the cross-sectional area of the rib is defined in the foregoing, the cross-sectional area of the rib will be more specifically described with reference to the drawing. FIG. 7 shows the same plan as that of FIG. 1 and is added in the interest of clarity. The description is made by way of example of the rib 72 of the six ribs. A position A (represented by a reference character "A" in FIG. 7) is defined to be spaced away from a longitudinal center position 7*c* of the overall length L (FIG. 7) of the rib 72 toward one end thereof by a distance (0.4 L) of 40% of the overall length thereof (which means hereinafter the overall longitudinal length of the rib). Likewise, a position B (represented by a reference character "B" in FIG. 7) is defined to be spaced away from the rib center position 7*c* toward the other end of the rib by a distance (0.4 L) of 40% of the overall length thereof. The cross-sectional area of the rib 72 is defined as a mean value of cross-sectional areas as determined at longitudinal positions between the position A and the position B.

It is preferred that a cross-sectional area of the rib as determined at place shifted from the position A toward the rib end and a cross-sectional area thereof as determined at place shifted from the position B toward the rib end are each greater than the above cross-sectional area of the rib (the mean value of the cross-sectional areas as determined at longitudinal positions between the position A and the position B). This is because the stress tends to concentrate particularly on the rib ends.

As described above, the ribs 71 to 76 are laid from the face center toward the face circumferences, thereby diffusing the stress exerted on the face more uniformly without excessively increasing the rigidity of the face.

The reason for providing six or more ribs is because if the number of ribs is less than six, rib-free regions are so large that the regions tend to suffer the insufficient strength. However, if the number of ribs is excessive, the face may be excessively increased in the rigidity so that the restitution performance may be lowered. Therefore, the number of ribs extended from the face center toward the face circumferences may preferably be 15 or less, more preferably 10 or less and particularly preferably 8 or less.

The angles θ1 to θ6 between the extension directions of the respective pairs of adjoining ribs are defined to be less than 90° for the following reason. If there exists a region having any one of the angles θ1 to θ6 that is 90° or more, the region tends to suffer the insufficient strength. Therefore, the angle may preferably be 80° or less. However, if the angle is too small, a region having such a small angle may be excessively increased in the rigidity so that the restitution performance may be lowered. Therefore, the angle between the extension directions of the respective pairs of adjoining ribs may preferably be 15° or more, more preferably 30° or more and particularly preferably 40° or more.

The upward rib 7 is configured to have the smaller cross-sectional area than that of each of the other ribs 72 to 76, whereby the head may achieve an increased restitution performance while maintaining the face reinforcement effect. The reason is as follows. A crown-side region from the face center has a wider margin of face strength than the other regions of the face. Therefore, the upward rib 7 configured to have the smaller cross-sectional area than that of each of the other ribs 72 to 76 exerts a smaller influence on the face reinforcement effect than a configuration where the cross-sectional areas of the other ribs 72 to 76 are decreased. On the other hand, a face width between the face center and the crown portion is relatively small. Hence, the rigidity at the crown-side region from the face center has a relatively great influence on the flexure of the overall face. Therefore, the upward rib 7 is configured to have the smaller cross-sectional area than that of each of the other ribs 72 to 76, whereby the head is effectively increased in the restitution performance while maintaining the face reinforcement effect.

A center 15*c* (a centroid or gravity center) of a rib convergence portion 15 (represented by hatched broken lines) shown in FIG. 7 may preferably be located at place within 4 mm from a center of the face backside 2*b* (an unillustrated centroid or gravity center of the face backside 2*b*). If the center 15*c* of the rib convergence portion 15 is excessively shifted toward any of the face circumferences, the stress exerted on the face may be less uniformly diffused to the individual ribs. On the other hand, if the center 15*c* of the rib convergence portion 15 is excessively shifted toward the crown side, the length of the upward rib 7 is excessively decreased so that the aforementioned effect attained by configuring the upward rib 7 to have the relatively small cross-sectional area may be reduced. The rib convergence portion 15 means a portion which is formed at the face center by the plural ribs intersecting one another and which cannot be determined to belong to which of the ribs.

Figure 2:
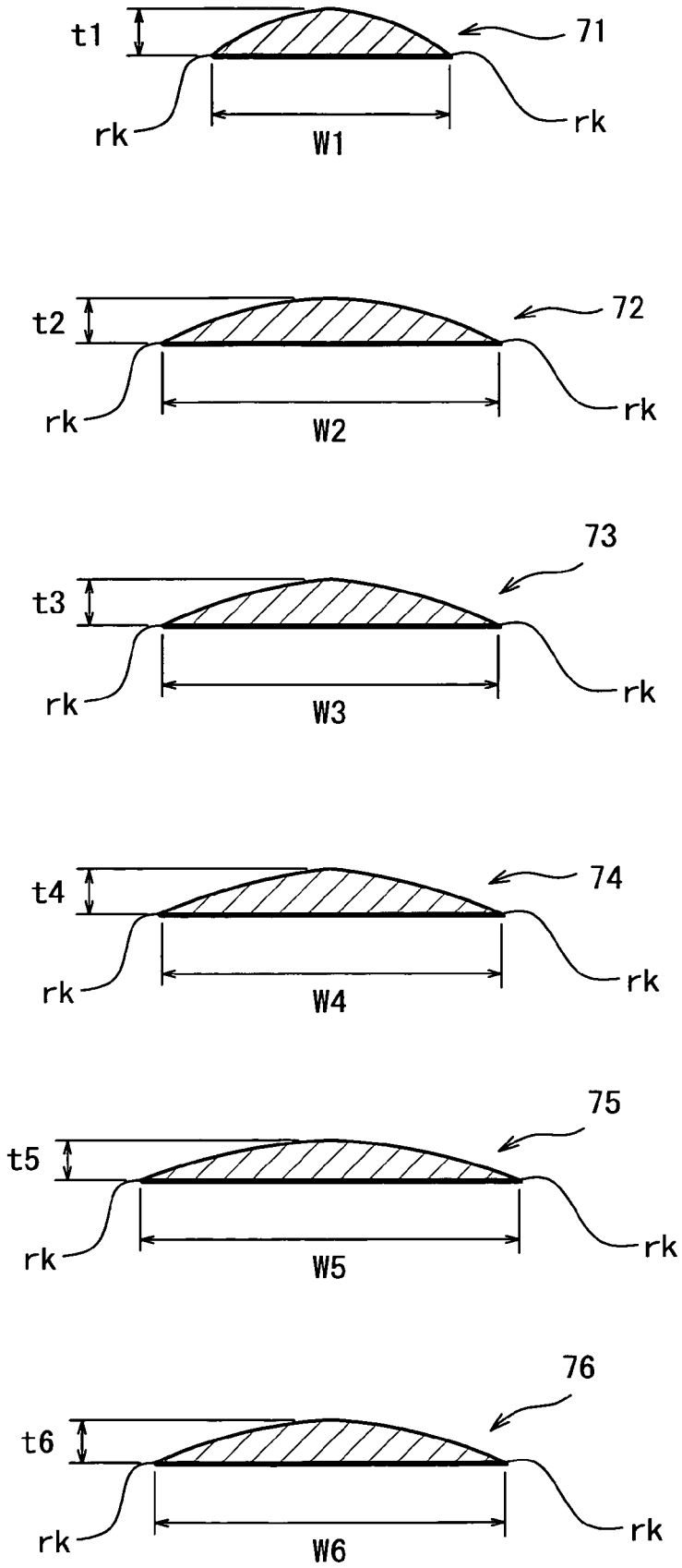
FIG. 2 is a group of sectional views showing the individual ribs shown in FIG. 1.

FIG. 2 shows cross-sections of the ribs 71 to 76 taken at the respective rib center positions 7*c* with respect to the longitudinal directions thereof. Each of the ribs 71 to 76 has constant sectional specifications (cross-sectional area, sectional shape, rib width, rib height) as determined at any positions with respect to the longitudinal length thereof, except for the opposite end portions thereof. Furthermore, the ribs 71 to 76 are each extended substantially straight. As shown in FIG. 2, each of the ribs 71 to 76 has a curved surface protruded toward the inside of the head. The rib height is progressively decreased from a widthwise center of the rib toward widthwise opposite sides thereof and is decreased nearly to zero at the opposite sides thereof. The sectional shape of the rib defines a smooth surface and does not include an acute angle, which is included in a rectangular sectional shape of the conventional rib. Such a configuration provides more uniform diffusion of the stress and allows the rib of a small volume to achieve a higher face reinforcement effect.

Individual widths W1 to W6 of the ribs 71 to 76 may preferably be in the range of 3 mm to 14 mm. If the rib width is less than 3 mm, the stress may be concentrated on a rib having a relatively small width so that the rib may be prone to fracture at an edge portion thereof. Therefore, the rib width may more preferably be 5 mm or more and particularly preferably 7 mm or more. The rib width is defined to be 14 mm or less for the following reason. If the rib width is more than 14 mm, the face is excessively increased in the rigidity so that the restitution performance tends to decrease. Therefore, the rib width may more preferably 12 mm or less, even more preferably 10 mm or less and particularly preferably 8 mm or less.

Individual heights t1 to t6 (FIG. 2) of the ribs 71 to 76 may preferably be in the range of 0.3 mm to 1.5 mm. The reason for defining the rib height to be 0.3 mm or more is because if the rib height is less than 0.3 mm, the face reinforcement effect by way of the ribs is reduced. Therefore, the rib height may more preferably 0.5 mm or more and even more preferably 0.7 mm or more. The reason for defining the rib height to be 1.5 mm or less is because if the rib height is more than 1.5 mm, the stress tends to be concentrated on the ribs. Therefore, the rib height may more preferably be 1.2 mm or less and even more preferably 1.0 mm or less.

A value given by dividing the rib height by the rib width [(rib height)/(rib width)] may preferably be 0.20 or less and more preferably 0.15 or less. If this value is excessive, the stress tends to be concentrated on the rib portion so that the stress diffusion may be reduced. In addition, the rib portion is excessively increased in the rigidity so that the face may be excessively reduced in the flexure and the restitution performance may be lowered. However, if the value of [(rib height)/(rib width)] is too small, a region increased in thickness by the rib is so large that the face may be reduced in the flexure, or the rib has such a small height that the face reinforcement effect may be reduced. Therefore, the value may preferably be 0.05 or more, more preferably 0.08 or more and particularly preferably 0.10 or more.

It is preferred that a face thickness (the thickness at the face portion 2) may preferably be 0.5 mm or more and 3.5 mm or less. The reason for defining the face thickness to be 0.5 mm or more is because the face having a thickness of less than 0.5 mm tends to suffer the insufficient strength. Therefore, the face thickness may more preferably be 1.0 mm or more and particularly preferably 1.5 mm or more. The reason for defining the face thickness to be 3.5 mm or less is because the face having a thickness of more than 3.5 mm is excessively increased in the rigidity, so that the restitution performance may be reduced. Therefore, the face thickness may more preferably be 3.0 mm or less and particularly preferably 2.7 mm or less.

A face thickness as determined at the rib-free region may preferably be 3.0 mm or less, more preferably 2.5 mm or less and particularly preferably 2.2 mm or less. Despite the reduced thickness at the rib-free region, the face may maintain the strength by virtue of the ribs disposed according the invention. Furthermore, it becomes easier to achieve the increased restitution performance when the face thickness is decreased. It is noted however that if the face is excessively reduced in thickness, the face may suffer the insufficient strength. Therefore, the face thickness at the rib-free region may preferably be 0.4 mm or more, more preferably 0.8 mm or more and particularly preferably 1.4 mm or more.

While the individual ribs 71 to 76 may be extended from the face center toward the face circumferences, the face-center-side ends of the ribs 71 to 76 may preferably be located within 4 mm from the center of the face backside 2*b* (the unillustrated centroid or gravity center of the face backside 2*b*). If the distance between the face-center-side end of the rib and the center of the face backside 2*b* is increased, the reinforcement effect by way of the ribs may fall short at an area around the face center which is most subjected to the stress. In addition, the ribs are reduced in the ability to uniformly diffuse the stress on the face center to the face circumferences.

Each of the ribs 71 to 76 may preferably be extended to place within 5 mm from the face outside circumference gs (the outside circumference of the face backside 2*b*). It is more preferred that the ribs are extended to the face outside circumference gs. If the distance between the face-circumference-side end of the rib and the face outside circumference gs is increased, the stress on the face center tends to be diffused to a limited area of the face circumferences. In addition, the reinforcement effect by way of the ribs may fall short at the face circumference.

Golf club heads were fabricated according to Examples 1 to 10 as the examples of the invention and according to Comparative Examples 1 to 3. The effects of the invention were examined by evaluating these golf club heads.

All the examples (Examples 1 to 10 and Comparative Examples 1 to 3) had the same specifications except for thickness distributions of the face portion. In the specifications common to the all examples, the examples used a titanium-alloy head which had the hollow structure including the cup-face substantially shaped like a cup and the head body combined with the cup-face by welding, just as in the aforementioned embodiment. The head had a volume of 405 cc and a face area (area of the face surface) of 4200 $mm^2$.

As to Examples 1 to 10, the rib-free region of the face portion had a thickness of 1.8 mm to 2.0 mm. All the ribs of Examples 1 to 10 were configured such that, as shown in FIG. 2, the rib height was progressively decreased from the widthwise center thereof toward the widthwise opposite ends thereof and was decreased nearly to zero at the widthwise opposite ends thereof.

Figure 3:
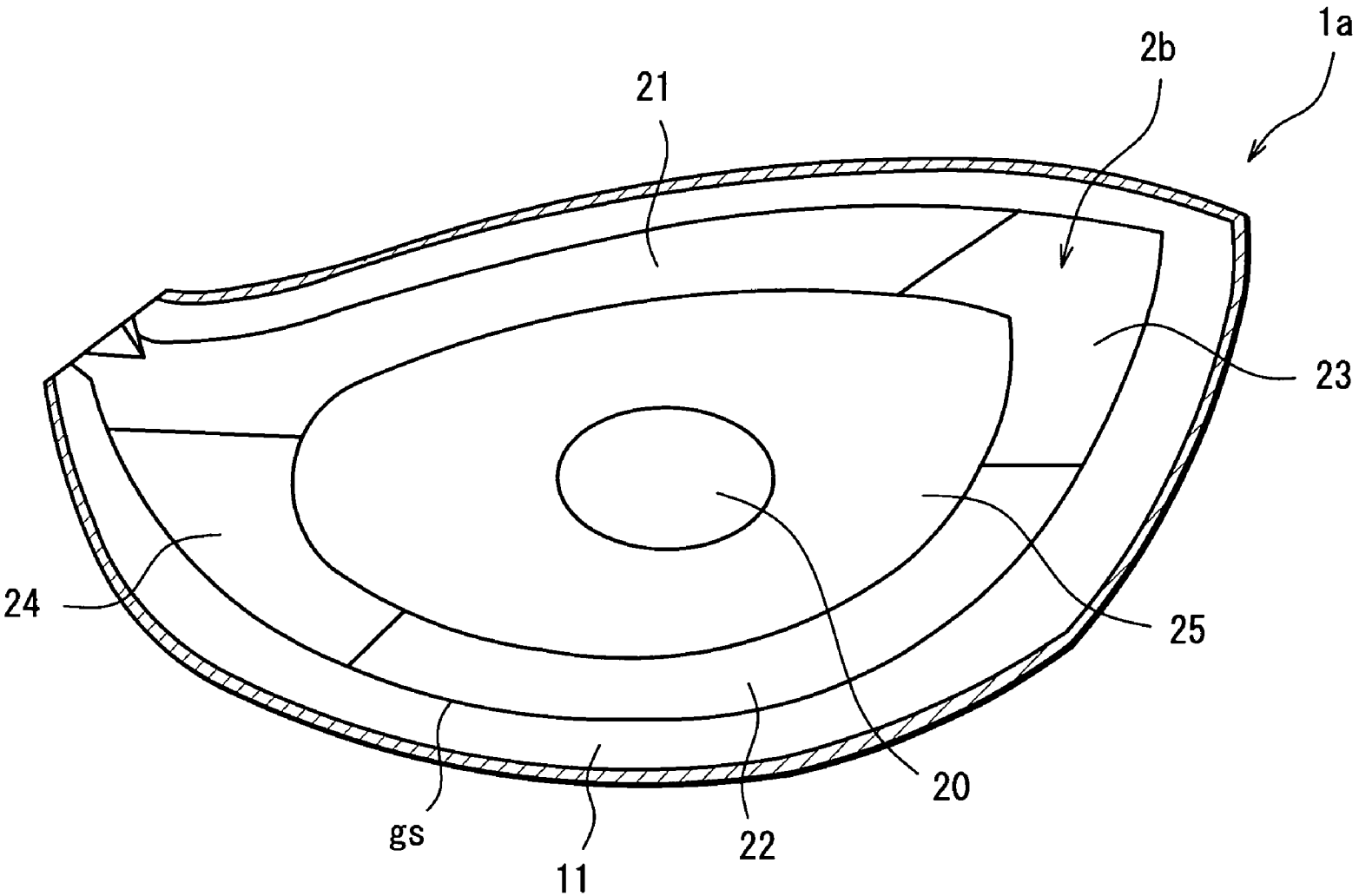
FIG. 3 is a plan view showing a cup-face of a golf club head according to Comparative Example 1 as viewed from place opposite the face backside.

On the other hand, the face backside 2*b* of Comparative Example 1 is shown in a plan view of FIG. 3. The face portion 2 of Comparative Example 1 has a thickness distribution wherein an elliptical central thicker portion 20 defined in the vicinity of the face center has a thickness of 2.85 mm, an upper face circumferential portion 21 on the crown side and a lower face circumferential portion 22 on the sole side have a thickness of 2.2 mm, a toe-side face circumferential portion 23 on the toe side and a heel-side face circumferential portion 24 on the heel side have a thickness of 2.0 mm, the upper, lower, toe-side and heel side face circumferential portions constituting the face circumferential portions. A transition portion 25 located between the central thicker portion 20 and the face circumferential portions 21 to 24 constitutes a slant surface for step-free, smooth connection between the central thicker portion 20 and the face circumferential portions 21 to 24. The thickness of the transition portion 25 is progressively varied toward face outer sides, or from the thickness of the central thicker portion 20 to the thicknesses of the face circumferential portions 21 to 24.

Figure 8:
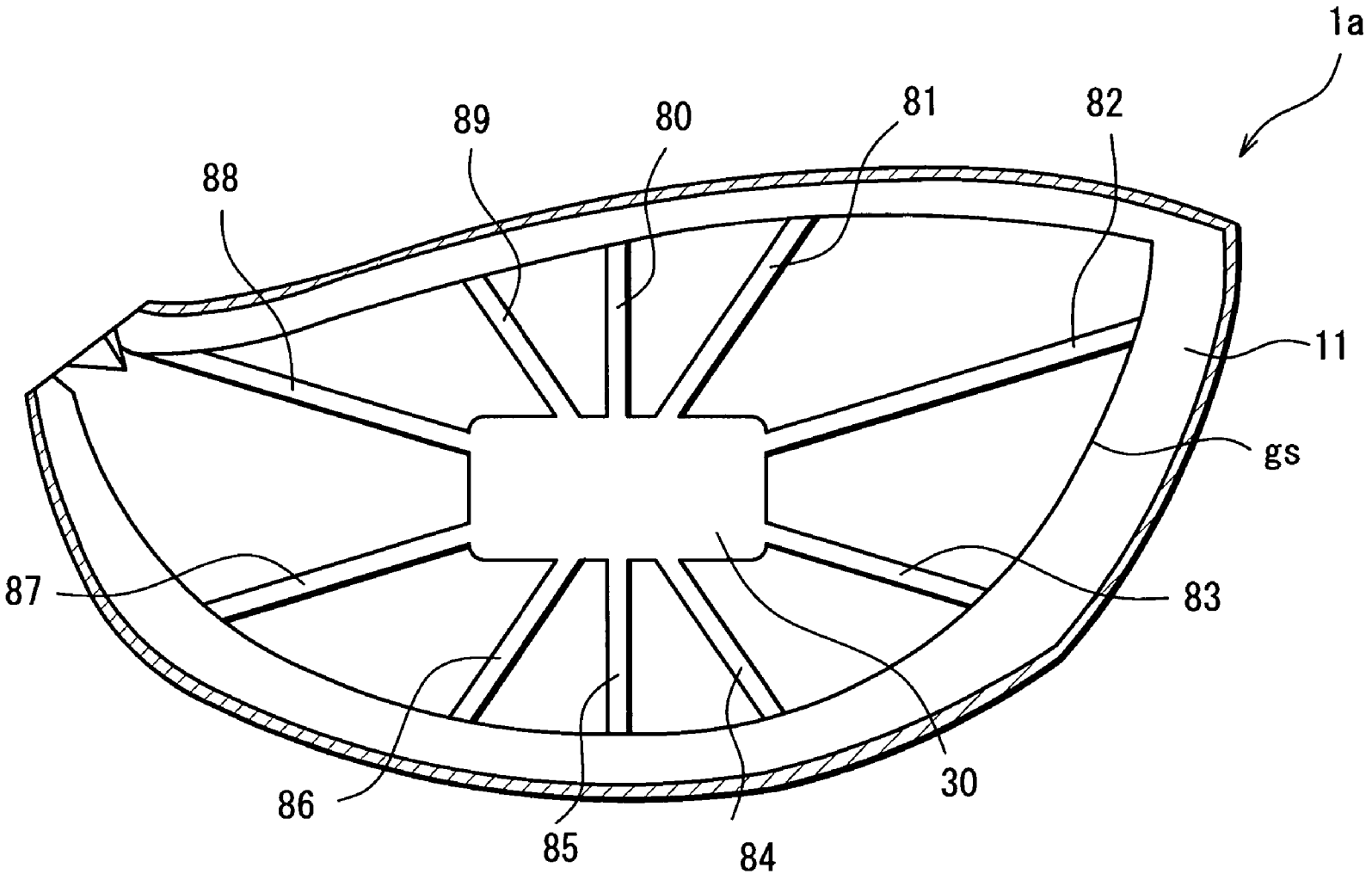
FIG. 8 is a plan view showing a cup-face of a golf club head according to Comparative Example 3 as viewed from place opposite the face backside.

On the other hand, the cup-face 1*a* of Comparative Example 3 is shown in a plan view of FIG. 8 as viewed from place opposite the face backside 2*b*. The head includes a central thicker portion 30 substantially shaped like a rectangle and located at the face center, and a total number of ten ribs 80 to 89 extended from the central thicker portion 30 toward the face circumferences. The central thicker portion 30 has a thickness of 2.85 mm. All the ribs 80 to 89 have the same width and height and have a quadrangle sectional shape. The face has a thickness of 1.85 mm at regions free from the ribs 80 to 89.

Figure 9:
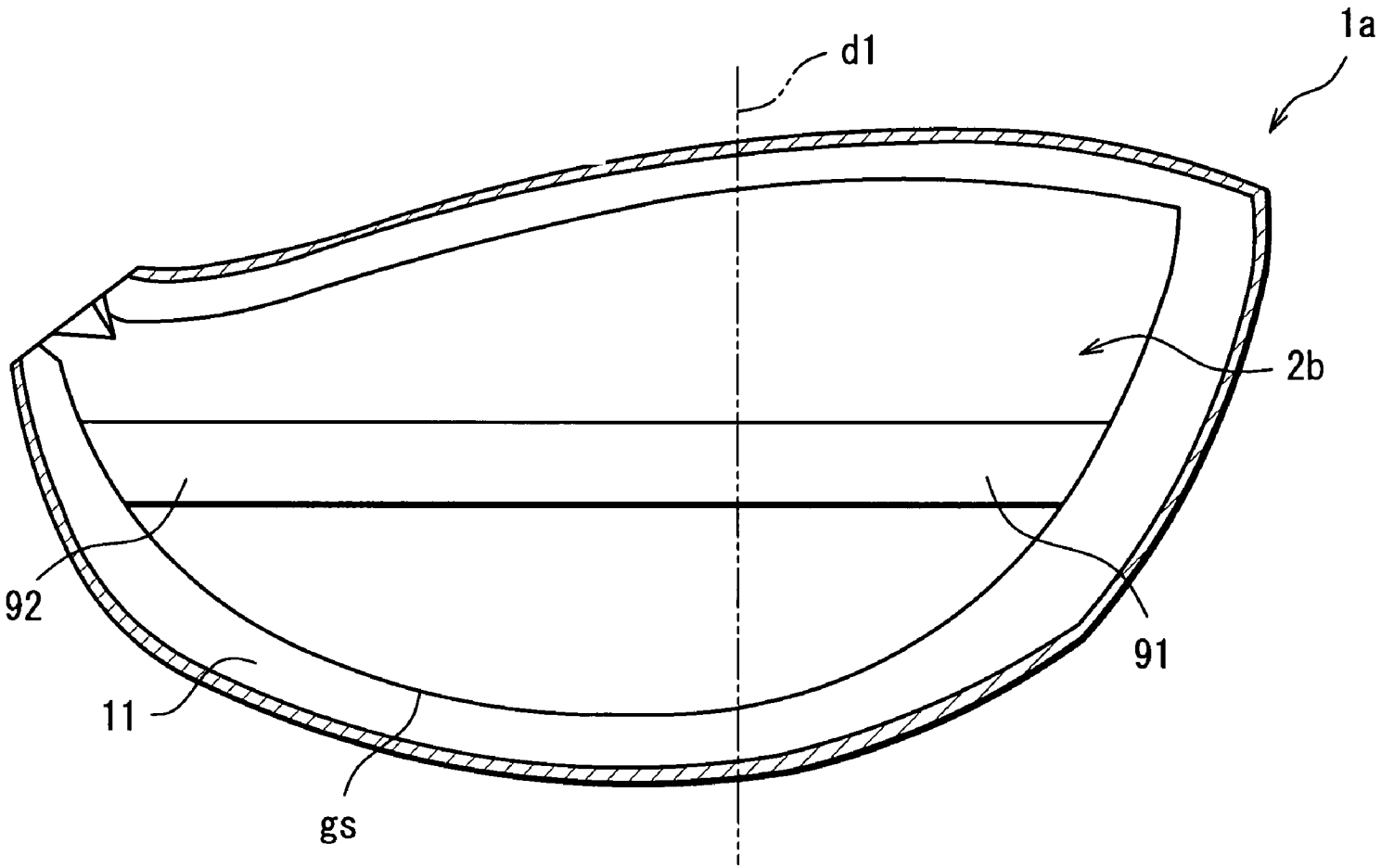
FIG. 9 is a plan view showing a cup-face of a golf club head according to Comparative Example 2 as viewed from place opposite the face backside.

The cup-face 1*a* of Comparative Example 2 is shown in a plan view of FIG. 9 as viewed from place opposite the face backside 2*b*. The head includes a rib 91 extended from the face center toward a toe-side circumference of the face; and a rib 92 extended from the face center toward a heel-side circumference of the face. The rib 91 and the rib 92 are laid substantially on a straight line, jointly constituting a single rib extended in the toe-heel direction. The ribs 91 and 92 have the same width and height with respect to the overall lengths thereof. Similarly to the examples of the invention, the ribs have the sectional shape shown in FIG. 2. The face has a thickness of 2.2 mm at regions free from the ribs 91, 92.

The specifications and evaluation results of the individual examples are listed in Table 1 and Table 2 as below.

TABLE 1

| | Ex. 1 | Ex. 2 | Ex. 3 | Ex. 4 | Ex. 5 | Ex. 6 |
|---|---|---|---|---|---|---|
| Number of ribs | 6 | 6 | 6 | 6 | 6 | 6 |
| Face backside view | FIG. 1 | FIG. 1 | FIG. 1 | FIG. 1 | FIG. 1 | FIG. 1 |
| Sectional area of upward rib ($mm^2$) | 4.3 | 5.8 | 4.1 | 4.1 | 6.0 | 6.0 |
| Width of upward rib (mm) | 8.0 | 8.0 | 8.0 | 8.0 | 8.0 | 8.0 |
| Height of upward rib (mm) | 1.02 | 1.02 | 1.02 | 1.02 | 1.02 | 1.02 |
| Mean sectional area of other rib ($mm^2$) | 6.1 | 7.5 | 5.8 | 6.1 | 7.4 | 7.6 |

TABLE 1-continued

| | Ex. 1 | Ex. 2 | Ex. 3 | Ex. 4 | Ex. 5 | Ex. 6 |
|---|---|---|---|---|---|---|
| Width of other rib (mm) | 10.0 | 10.0 | 10.0 | 10.0 | 10.0 | 10.0 |
| Height of other rib (mm) | 1.02 | 1.02 | 1.02 | 1.02 | 1.02 | 1.02 |
| R1 and R4 (mm) | 6 | 6 | 6 | 6 | 6 | 6 |
| R2 and R5 (mm) | 3 | 3 | 3 | 3 | 3 | 3 |
| R3 and R6 (mm) | 8 | 8 | 8 | 8 | 8 | 8 |
| θ1 and θ4 (°) | 65 | 65 | 65 | 65 | 65 | 65 |
| θ2 and θ5 (°) | 40 | 40 | 40 | 40 | 40 | 40 |
| θ3 and θ6 (°) | 75 | 75 | 75 | 75 | 75 | 75 |
| (θ1/R1) and (θ4/R4) | 11 | 11 | 11 | 11 | 11 | 11 |
| (θ2/R2) and (θ5/R5) | 13 | 13 | 13 | 13 | 13 | 13 |
| (θ3/R3) and (θ6/R6) | 9 | 9 | 9 | 9 | 9 | 9 |
| Area of high restitution area ($mm^2$) | 512 | 506 | 530 | 525 | 504 | 455 |
| Percentage of high restitution area (%) | 12.5 | 12.3 | 12.9 | 12.8 | 12.3 | 11.1 |
| Durability | ○ | ○ | ○ | ○ | ○ | ○ |

TABLE 2

| | Ex. 7 | Ex. 8 | Ex. 9 | Ex. 10 | CEx. 1 | CEx. 2 | CEx. 3 |
|---|---|---|---|---|---|---|---|
| Number of ribs | 6 | 6 | 6 | 6 | 0 | 2 | 10 |
| Face backside view | FIG. 1 | FIG. 1 | FIG. 1 | FIG. 1 | FIG. 3 | FIG. 9 | FIG.8 |
| Sectional area of upward rib ($mm^2$) | 5.8 | 5.8 | 5.8 | 5.8 | — | — | 5.0 |
| Width of upward rib (mm) | 8.0 | 8.0 | 8.0 | 8.0 | — | — | 5.0 |
| Height of upward rib (mm) | 1.02 | 1.02 | 1.02 | 1.02 | — | — | 1.00 |
| Mean sectional area of other rib ($mm^2$) | 7.5 | 7.5 | 7.5 | 7.5 | — | 10.0 | 5.0 |
| Width of other rib (mm) | 10.0 | 10.0 | 10.0 | 10.0 | — | 10.0 | 5.0 |
| Height of other rib (mm) | 1.02 | 1.02 | 1.02 | 1.02 | — | 1.00 | 1.00 |
| R1 and R4 (mm) | 1.5 | 14 | 3 | 11 | — | — | — |
| R2 and R5 (mm) | 1.5 | 14 | 2 | 6 | — | — | — |
| R3 and R6 (mm) | 1.5 | 14 | 3.5 | 12 | — | — | — |
| θ1 and θ4 (°) | 65 | 65 | 65 | 65 | — | — | — |
| θ2 and θ5 (°) | 40 | 40 | 40 | 40 | — | — | — |
| θ3 and θ6 (°) | 75 | 75 | 75 | 75 | — | — | — |
| (θ1/R1) and (θ4/R4) | 43 | 5 | 22 | 6 | — | — | — |
| (θ2/R2) and (θ5/R5) | 27 | 3 | 20 | 7 | — | — | — |
| (θ3/R3) and (θ6/R6) | 50 | 5 | 21 | 6 | — | — | — |
| Area of high restitution area ($mm^2$) | 552 | 461 | 534 | 483 | 445 | 515 | 447 |
| Percentage of high restitution area (%) | 13.5 | 11.2 | 13.0 | 11.8 | 10.9 | 12.6 | 10.9 |
| Durability | Δ | ○ | ○ | ○ | ○ | X | ○ |

Description is made on the individual items in the tables.

The "number of ribs" means the number of ribs extended from the face center toward the face circumferences.

The "face backside view" means the number of the figure showing the face backside of each example in plan.

The definitions of θ1 to θ6 and R1 to R6 are as shown in FIG. 1 and described in the foregoing.

The "mean sectional area of other rib ($mm^2$)" means the mean value of the cross-sectional areas of each of the other ribs than the upward rib, the ribs being extended from the face center toward the face circumferences.

Next, description is made on the "area of high restitution area ($mm^2$)".

In a contour plot of restitution coefficient distribution produced by a predetermined method, the high restitution area means the area on the face surface that has a restitution coefficient of 0.84 or more.

The contour plot of restitution coefficient distribution was produced as follows. First, a grid with the sweet spot on the face surface located at its center was formed by drawing straight lines in the head vertical direction and the toe-heel direction (perpendicular to the head vertical direction as seen on the face surface) at 5 mm-intervals. The restitution coefficient of the head was measured at each of the intersections thus formed (hereinafter, also referred to as "grid point"). A measurement range was defined as 20 mm toward the toe side and 20 mm toward the heel side from the sweet spot and 15 mm toward the crown side and 15 mm toward the sole side from the sweet spot with respect to the head vertical direction.

Figure 5:
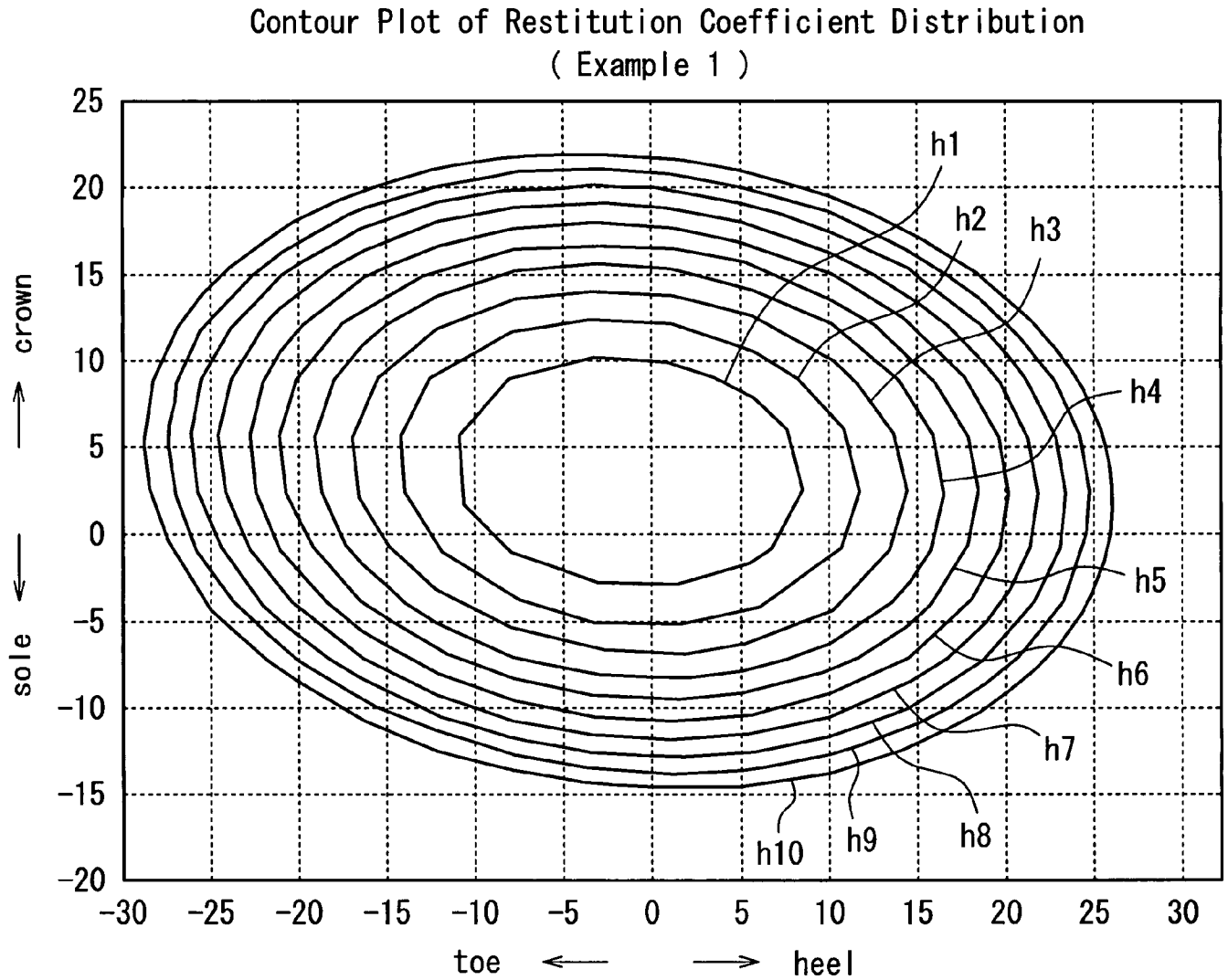
FIG. 5 is a contour plot showing the contours of restitution coefficient distribution of the head of Example 1.
Figure 6:
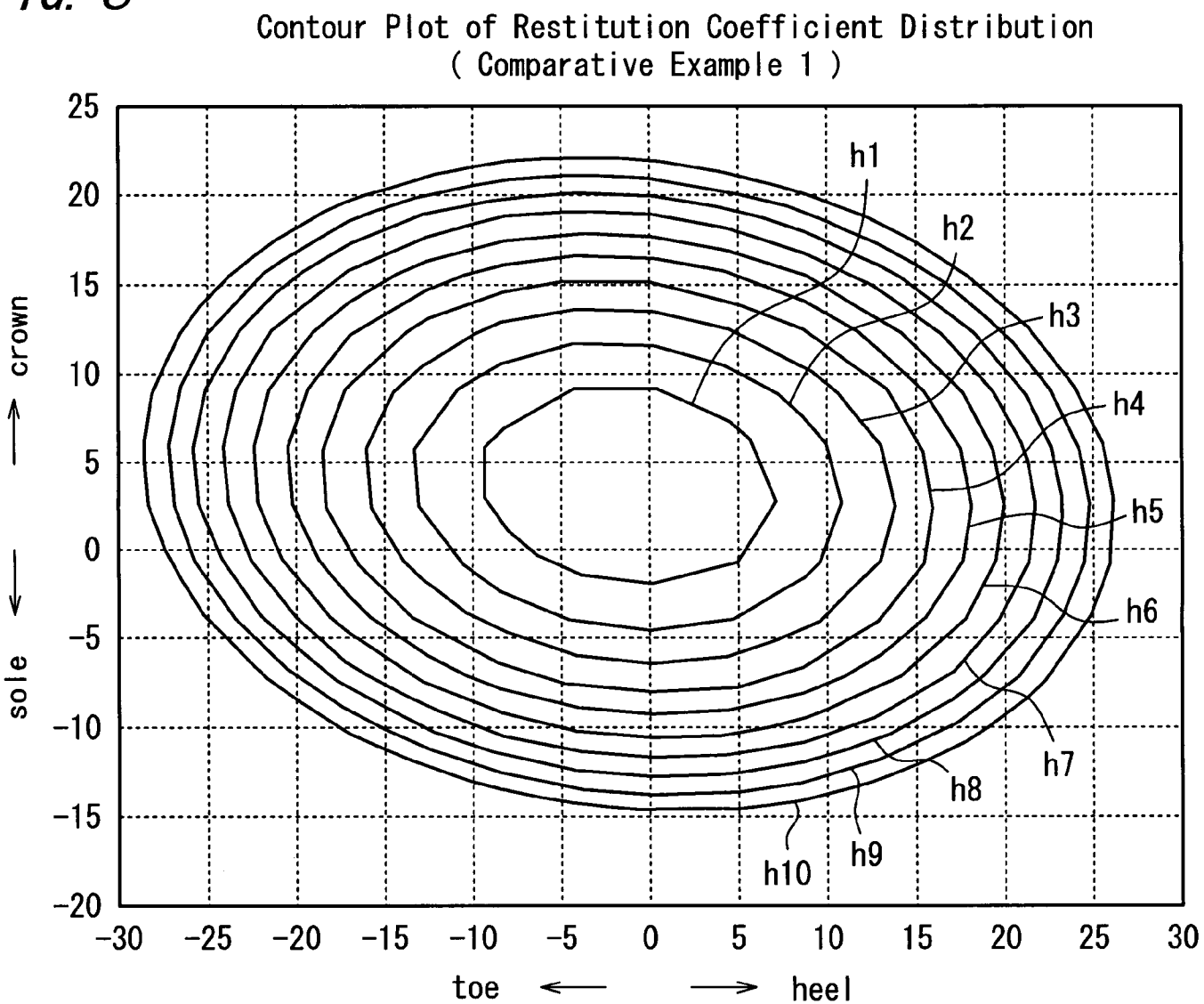
FIG. 6 is a contour plot showing the contours of restitution coefficient distribution of the head of Comparative Example 1.

The measurements of restitution coefficient taken at the individual grid points were applied to a statistical software (STATISTICA commercially available from StataSoft. Inc.) so as to produce the contour plot of restitution coefficient distribution showing the restitution coefficient distribution in the form of contour lines. FIG. 5 is a contour plot showing the contours of restitution coefficient distribution of the head of Example 1. FIG. 6 is a contour plot showing the contours of restitution coefficient distribution of the head of Comparative Example 1. In these plots, the numerical values on the ordinate indicate the distance (mm) from the sweet spot with respect to the head vertical direction, whereas the numerical values on the abscissa indicate the distance (mm) from the sweet spot with respect to the toe-heel direction (the direction perpendicular to the head vertical direction as seen on the face surface). In FIG. 5 and FIG. 6, the plural substantially elliptical contour lines are sequentially called Contour Line h1, Contour Line h2, Contour Line h3, . . . Contour Line h10, starting from the innermost contour line. An area inside Contour Line h1 is an area where the restitution coefficient is 0.85 or more. An area inside Contour Line h2 is an area where the restitution coefficient is 0.84 or more. An area inside Contour Line h3 is an area where the restitution coefficient is 0.83 or more. In this manner, the contour lines represent the restitution coefficients in 0.01 decrements. That is, the outer contour line represents the boundary of the area of the lower restitution coefficient. The area of the area enclosed by Contour Line h2 is the "area of high-restitution area ($mm^2$)". The percentage of the area of the high-restitution area based on the area of the overall face surface is the "percentage of high restitution area" in the tables.

The "durability" was evaluated as follows. The shaft and grip were mounted to the head of each of the examples so as to fabricate a golf club. The resultant golf club was attached to a swing robot to hit 1000 balls at a head speed of 50 m/s. The robot was adjusted to hit the ball on the face center as the ball impact point. The face surfaces of the heads were examined for dents produced by the impact with the balls. A head sustaining a dent of a depth of 0.1 mm or less was rated as ○, whereas a head sustaining a dent of a depth of more than 0.1 mm was rated as Δ. A head sustaining face surface fracture before 1000 balls were hit was rated as X.

When the aforementioned contour plot of restitution coefficient distribution was produced, the restitution coefficients at the respective grid points were determined based on a method analogous to the Procedure for Measuring the Velocity Ratio of a Club Head for Conformance to Rule 4-1e, Revision 2 (Feb. 8, 1999) specified by USGA. Specifically, a golf ball was shot by means of a ball shooting machine so as to strike on the face portion of the head at place near the aforesaid grid point, the head being unfixedly placed on a base. The restitution coefficient at each grid point was determined as follows. The ball was shot square on the face surface at place 5 mm or less from the grid point on the head. The measurement was taken on the incident velocity Vi of the golf ball just before impact and on the bounce-back velocity Vo thereof. Provided that Vi represents the incident velocity of the golf ball, Vo represents the bounce-back velocity thereof, M represents the head mass and m represents the mean mass thereof, the restitution coefficient e at each grid point was calculated based on the following equation:

$$(Vo/Vi)=(eM-m)/(M+m)$$

Incidentally, a distance between a golf-ball shooting aperture and the face portion was defined as 1 m. The golf balls used in the measurement were Pinacle Gold Series commercially available from Titleit Inc. The initial ball velocity was set to 48.77 m/s. Further, the velocity sensors were positioned at places 360.2 mm from the head, respectively.

According to the comprehensive evaluation of the areas of high-restitution areas (percentages) and the durability, the examples of the invention achieved the better results than the comparative examples, as shown in the tables.

What is claimed is:

1. A golf club head comprising six or more ribs disposed on a face backside, the ribs being extended from a face center toward face circumferences, wherein an angle θ(°) between extension directions of adjoining ribs is less than 90°, wherein one of the ribs that forms the smallest angle between its extension direction and a head vertical direction and that extends from the face center toward a crown-side face circumference constitutes an upward rib, which has a smaller cross-sectional area than any of those of the other ribs, and wherein the ribs have widths of 3 mm to 14 mm and heights of 0.3 mm to 1.5 mm.

2. The golf club head according to claim 1, wherein the upward rib has the cross-sectional area of 2.0 to 8.0 $mm^2$, and the other ribs have the cross-sectional areas of 4.0 to 10.0 $mm^2$.

3. The golf club head according to claim 1, wherein a face thickness is 0.5 mm or more and 3.5 mm or less.

4. The golf club head according to claim 1, wherein a roundness of a curvature radius R(mm) is imparted to an intersection of boundary lines of adjoining ones of the ribs and wherein the value of a ratio (θ/R) between the curvature radius R(mm) and the angle θ(°) between the adjoining ribs is in the range of 3 to 50.

5. A golf club head comprising six or more ribs disposed on a face backside, the ribs being extended from a face center toward face circumferences, wherein an angle θ(°) between extension directions of adjoining ribs is less than 90°, wherein one of the ribs that forms the smallest angle between its extension direction and a head vertical direction and that extends from the face center toward a crown-side face circumference constitutes an upward rib, which has a smaller cross-sectional area than any of those of the other ribs, and wherein a roundness of a curvature radius R(mm) is imparted to an intersection of boundary lines of adjoining ones of the ribs and wherein the value of a ratio (θ/R) between the curvature radius R(mm) and the angle θ(°) between the adjoining ribs is in the range of 3 to 50.

6. A golf club head comprising six or more ribs disposed on a face backside, the ribs being extended from a face center toward face circumferences, wherein an angle θ(°) between extension directions of adjoining ribs is less than 90°, wherein one of the ribs that forms the smallest angle between its extension direction and a head vertical direction and that extends from the face center toward a crown-side face circumference constitutes an upward rib, which has a smaller cross-sectional area than any of those of the other ribs, and wherein a value given by dividing a rib height by the rib width is 0.05 or more and 0.20 or less.

7. A golf club head comprising six or more ribs disposed on a face backside, the ribs being extended from a face center toward face circumferences, wherein an angle θ(°) between extension directions of adjoining the ribs is less than 90°, wherein one of the ribs that forms the smallest angle between its extension direction and a head vertical direction and that extends from the face center toward a crown-side face circumference constitutes an upward rib, which has a smaller cross-sectional area than any of those of the other ribs, and wherein the boundary lines dividing each of the ribs from non-rib portions exist on widthwise either side of each rib, and each intersection of the boundary lines of adjoining ribs is rounded to impart a roundness of a curvature of a curvature radius R=1 to 15 mm.

8. A golf club head comprising six or more ribs disposed on a face backside, the ribs being extended from a face center toward face circumferences, wherein an angle θ(°) between extension directions of adjoining ribs is less than 90°, wherein one of the ribs that forms the smallest angle between its extension direction and a head vertical direction and tat extends from the face center toward a crown-side face circumference constitutes an upward rib, which has a smaller cross-sectional area than any of those of the other ribs, and wherein boundary lines dividing each of the ribs from non-rib portions exist on widthwise either side of each rib, and each intersection of the boundary lines of adjoining ribs is rounded to impart a roundness of a curvature radius R, and wherein relationships R(1)≧R2≧. . . ≧R(m) and R(1)≧R(m) are satisfied, provided that plural angles θ, each of angles θ being defined by respective pair of adjoining ribs, are represented by θ(1), θ(2), . . . , θ(m) in the descending order of the values thereof, that an inter-rib curvature radius R with respect to the angle θ(1) is represented by R(1), that an inter-rib curvature radius R with respect to the angle θ(2) is represented by R(2), . . . , and that an inter-rib curvature radius R with respect to the angle θ(m) is represented by R(m).

* * * * *